US006017283A

United States Patent [19]

Hagey

[11] Patent Number: 6,017,283

[45] **Date of Patent: *Jan. 25, 2000**

[54] CONTOURED GRIP FOR A RACQUET

[76] Inventor: Edward H. Hagey, 3653 Jennifer St., San Diego, Calif. 92117

[ * ] Notice: This patent is subject to a terminal disclaimer.

[21] Appl. No.: 08/812,906

[22] Filed: Mar. 10, 1997

Related U.S. Application Data

[63] Continuation-in-part of application No. 08/793,351, Feb. 24, 1997, Pat. No. 5,924,941, and a continuation-in-part of application No. 08/459,302, Jun. 2, 1995, Pat. No. 5,671,926, which is a continuation-in-part of application No. 08/363,606, Dec. 23, 1994, Pat. No. 5,492,324.

[51] Int. Cl.[7] ..... A63B 49/08

[52] U.S. Cl. ..... 473/551; 473/549

[58] Field of Search ..... 473/549, 551, 473/552, 568, 298, 300

[56] References Cited

U.S. PATENT DOCUMENTS

| | | | |
|---|---|---|---|
| 412,479 | 10/1889 | Davis . | |
| 2,031,161 | 2/1936 | Hamel . | |
| 2,302,191 | 11/1942 | Covington . | |
| 3,189,069 | 6/1965 | Stowell | 473/298 X |
| 4,065,127 | 12/1977 | Fagan . | |
| 4,067,573 | 1/1978 | Key, Jr. . | |
| 4,213,609 | 7/1980 | Swanson . | |
| 4,355,803 | 10/1982 | Rama . | |
| 4,438,925 | 3/1984 | Lindstrom . | |
| 4,537,399 | 8/1985 | Adam | 473/552 |
| 4,545,584 | 10/1985 | Adam . | |
| 4,641,838 | 2/1987 | Gabrielidis . | |
| 4,691,926 | 9/1987 | Adam | 473/552 |
| 4,736,950 | 4/1988 | Doyle . | |
| 4,828,261 | 5/1989 | Kleylein . | |
| 4,848,746 | 7/1989 | Klink . | |
| 4,934,024 | 6/1990 | Sexton, I | 473/551 |
| 4,968,032 | 11/1990 | Redekop . | |
| 5,018,734 | 5/1991 | Allsop . | |
| 5,034,082 | 7/1991 | Nolan | 473/549 X |
| 5,042,804 | 8/1991 | Uke et al. . | |
| 5,269,516 | 12/1993 | Janes . | |
| 5,295,684 | 3/1994 | Bracho . | |
| 5,316,316 | 5/1994 | Lai . | |
| 5,322,278 | 6/1994 | Jeanrot . | |
| 5,398,930 | 3/1995 | Gibson . | |
| 5,460,372 | 10/1995 | Cook . | |
| 5,492,324 | 2/1996 | Hagey . | |
| 5,599,019 | 2/1997 | Davis et al. | 473/549 |
| 5,653,643 | 8/1997 | Falone et al. | 473/300 |

FOREIGN PATENT DOCUMENTS

| | | |
|---|---|---|
| 519312A1 | 12/1992 | European Pat. Off. . |
| 2232337 | 2/1975 | France . |
| 3628618 | 11/1987 | Germany . |
| 3726753 | 2/1989 | Germany . |
| 3733425 | 2/1989 | Germany . |
| 3842126 | 8/1990 | Germany . |
| 4019039 | 12/1991 | Germany . |
| 157421 | 5/1991 | Taiwan . |
| 210025 | 7/1993 | Taiwan . |
| 220169 | 2/1994 | Taiwan . |
| 230376 | 9/1994 | Taiwan . |
| 662110 | 5/1979 | U.S.S.R. . |
| 20882 | 4/1909 | United Kingdom . |
| 2133294 | 7/1984 | United Kingdom . |
| WO8902297 | 3/1989 | WIPO . |

OTHER PUBLICATIONS

English language translation of German Patent No. 3733425.

*Primary Examiner*—Raleigh W. Chlu
*Attorney, Agent, or Firm*—Walter W. Duft

[57] ABSTRACT

A racquet handle having a contoured topography providing unique configurations that increase the player's racquet head awareness and which may be manufactured as an assembly adjustable along the length of the handle which will aid in positioning a player's hand in advantageous positions for stroke improvement.

35 Claims, 8 Drawing Sheets

FIG. 15
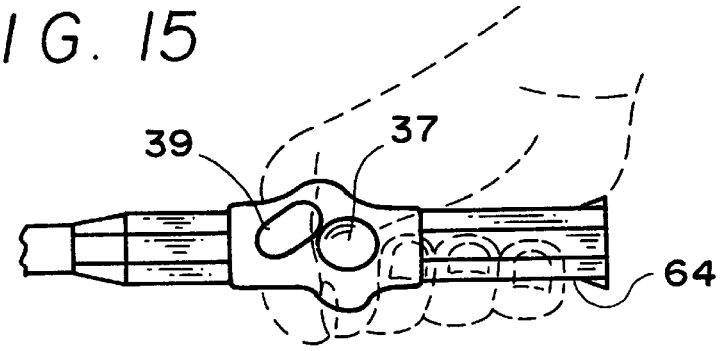
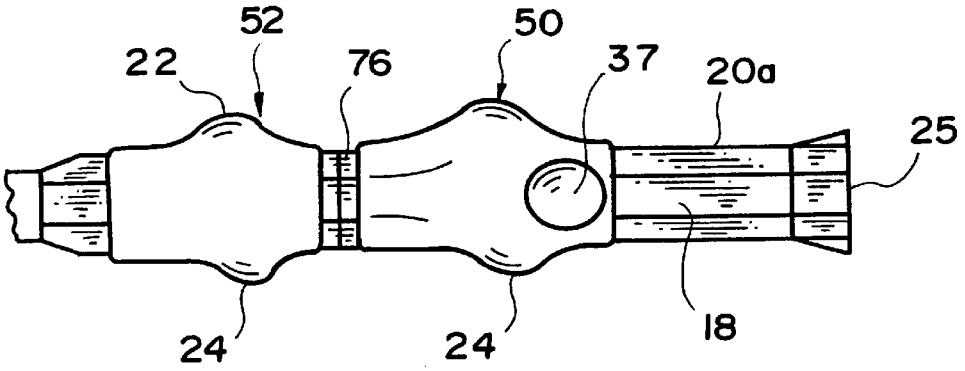
FIG. 16
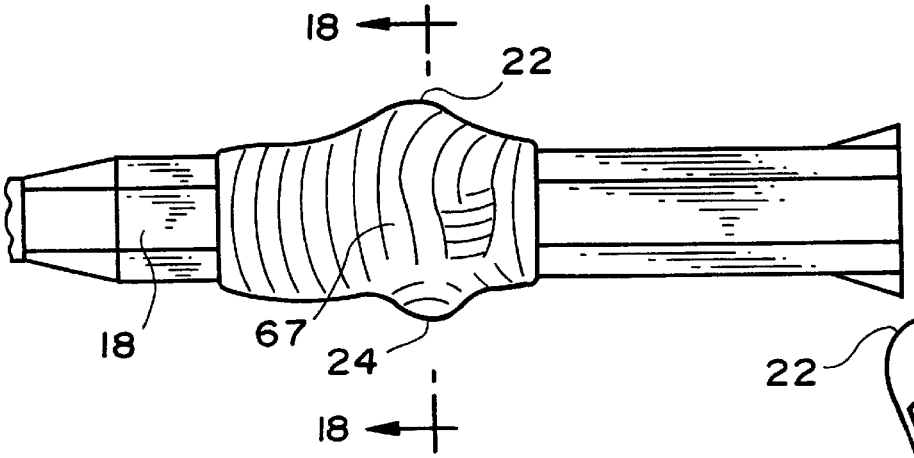
FIG. 17
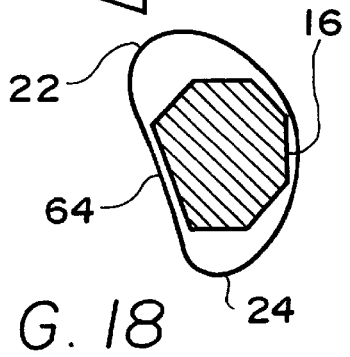
FIG. 18

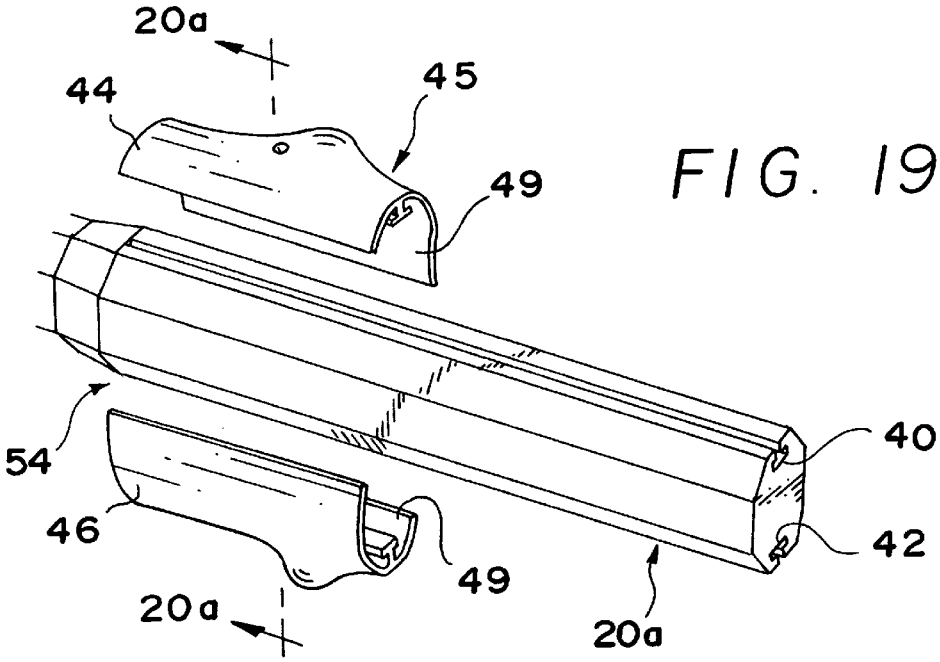
FIG. 19a
FIG. 20a
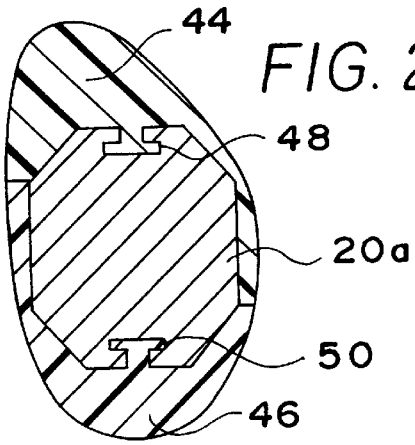
FIG. 21a
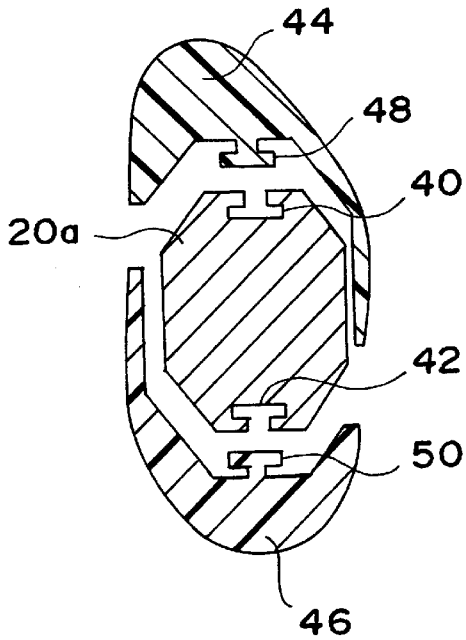
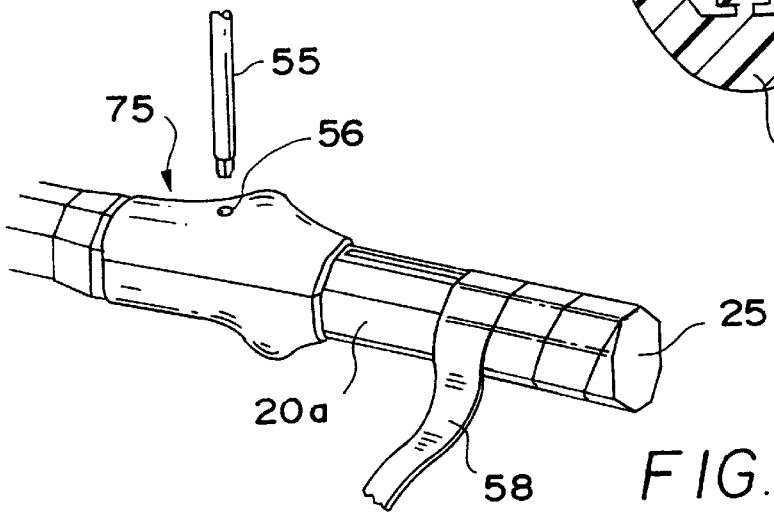
FIG. 22a

CONTOURED GRIP FOR A RACQUET

This is a continuation-in-part of co-pending U.S. patent application Ser. No. 08/459,302 filed Jun. 2, 1995, now U.S. Pat. No. 5,671,926 which is incorporated herein by this reference, and which is itself a continuation-in-part of U.S. patent application Ser. No. 08/363,606 filed Dec. 23, 1994, now U.S. Pat. No. 5,492,324. This is also a continuation-in-part of co-pending U.S. patent application Ser. No. 08/793,351 filed Feb. 24, 1997 now U.S. Pat. No. 5,924,941.

BACKGROUND OF THE INVENTION

The present invention is directed to further improvements in racquets for use in several sports, but is particularly directed toward an improved gripping area for a tennis racquet handle.

Of all the racquet sports, tennis is unique in its ball speed (pace) and the great deal of court coverage required by the players. Players must hit many balls on the run or after traveling great distances. For expert play, it is essential that during these maneuvers the player have a superb sense or awareness of the location and attitude (angular disposition) of the racquet head with respect to the player's hand. Sometimes the ball must be struck when it has little or no speed. At other times, the racquet will encounter high impact forces because of the pace with which the opponent has struck the ball. Additionally, the player must return tennis balls with various spins. The player is oftentimes required to change grips while on the run. Racquet preparation and proper grip are essential to expert play. Players must change their grips while running and under other difficult circumstances.

There have been many improvements in tennis racquets in the past several decades. Prior to 1970, almost all racquets were made of laminated wood. This limited the size of racquet heads and, consequently, almost all racquet heads had the same dimensions. For many years, manufacturers have made handles of different peripheral sizes, almost all of which were octagonal. With the advent of steel, aluminum, fiberglass, and graphite racquets, size limitations have been substantially eliminated and racquet heads have become larger.

With larger racquet heads, off-center contact with the ball creates greater torque. When a fast-moving tennis ball is struck any place but in the so-called "sweet spot," a great deal of torque is imparted to the racquet which must be resisted by the hand of the racquet user. This makes racquet head awareness of even greater importance. Racquet head awareness is that sense of knowing the angular relationship and distance of the stringed head to the hand. Topographical features on the handle which are felt and recognized by the player's hand enhance awareness. Although conventional octagonal handles impart some awareness, the instant invention described herein increases awareness dramatically.

For almost a century, tennis racquet handles have been octagonal in cross section. After about 1930, it became common to wrap the octagonal handle with a leather strip for comfort and friction. This racquet handle design is almost universally used in tennis racquets at the present time. Before leather wrappings became popular, many handles had grooves and ridges to increase friction. A collar or retention ridge was often secured to the base end of the handle to prevent slippage.

In order to appreciate the full measure of this invention, it should be understood that the vast majority of players use two different grips when stroking the ball. One grip is used for the forehand and the other grip is used for the backhand. Players typically use the backhand grip, or a grip between the forehand and backhand grip, for the serve. Grips vary from player-to-player and the teachings herein disclose handles which will accommodate the requirements of many players.

The most common forehand grip (known as the Eastern forehand), and that preferred by many tennis instructors, places the first knuckle of the index finger squarely behind one of the planar surfaces of the octagonal handle, the palm is in engagement with that planar surface parallel to the plane of the racquet head, and the butt of the hand against a retention ridge. The fingers are angularly disposed with respect to the handle axis.

In the grip known as the Eastern backhand, the hand is rotated until the finger segments between the first and second knuckles of the third, fourth, and fifth fingers are in a plane parallel to the racquet head. The thumb is typically placed diagonally across the opposite planar surface. This specification will use this grip terminology for purposes of explanation.

Some players do not like the "feel" of these commonly-used grips and will rotate the hand to one side or the other. This can reduce power and, in many instances, reduce racquet head awareness. In the embodiments described herein, contours are disclosed which will accommodate a variety of grips without the loss of power or racquet head awareness. In some instances, an improper grip is assumed because of a lack of skill or because of the difficult circumstances encountered during a grip change. The configuration and contours of the handle herein described will permit a considerable array of grips and at the same time aid the user in reaching a desired grip.

As taught in my co-pending applications, there is a bowl or protrusion to receive the area between the thumb and forefinger and a trigger to receive the index finger. The protrusion and the trigger increase the player's awareness of his or her hand along the length of the handle and increase racquet control. In one embodiment of the instant invention, a second protrusion is provided adjacent the trigger so that the player will have additional racquet handle awareness and control during certain strokes. In another embodiment of the instant invention, the first protrusion is located on one side of the handle axis and defines a surface extending at a skewed angle to the axis to engage the base of a player's index finger. If desired, the first protrusion can be extended beyond the side of the handle. In addition, a thumb depression can be provided below the first protrusion and an extended thumb support lip can be provided below the thumb depression. In another embodiment of the instant invention, an angled surface is provided on one side of the handle to support the first knuckle of a user's forefinger in a Western forehand grip. In yet another embodiment of the instant invention, a concavity is provided in the handle to receive a player's third, fourth, and fifth fingers, which helps facilitate a backhand grip. In a further embodiment of the instant invention, a thumb groove can be provided approximately transverse of the axis of the racquet so that a Western backhand is facilitated. In still another embodiment of the instant invention, a pair of thumb depressions are provided. In a still further embodiment of the instant invention, a pair of handle contour areas are provided for two-handed backhand play. One contour area is for the right hand and one is for the left hand. In a still further embodiment, an angled surface is provided for a user's thumb to facilitate top spin backhand strokes. In a still further embodiment, a thumb depression is formed in combination with either a bowl or protrusion to receive the area between the thumb and forefinger, or a trigger to receive the index finger. Alternatively, either a bowl or protrusion, or a trigger, could be provided by itself without a thumb depression.

In addition to the foregoing embodiment, a novel construction in accordance with the instant invention allows contoured areas formed in accordance with the invention to be adjustably mounted on a conventional handle as an alternative to molding a contour on a handle during racquet manufacture. A racquet for a right-handed player is described herein, but it should be understood that left-handed racquets are just the reverse.

SUMMARY OF THE INVENTION

With the above in mind, this invention has a principal objective to provide a new handle configuration for a tennis racquet which combines the geometry of the player's hand with preferred racquet movement so that maximum power and control is obtained by the user.

A further objective of this invention is to provide a handle configuration which makes the player fully aware of the location of his hand along the length of the handle.

Another objective of the invention is to provide a bowl or protrusion to receive the area of a user's hand between the thumb and forefinger, and a trigger to receive the index finger. The protrusion and the trigger increase the player's awareness of his or her hand along the length of the handle and increase racquet control.

Still another objective of the invention is to provide a second protrusion adjacent the trigger so that the player will have additional racquet handle awareness and control during certain strokes.

Still another objective of the invention is to locate the first protrusion on one side of the handle axis and define a surface extending at a skewed angle to the axis to engage the base of a player's index finger. If desired, the first protrusion can be extended beyond the side of the handle. In addition, a thumb depression can be provided below the first protrusion and an extended thumb support lip can be provided below the thumb depression.

Still another objective of the invention is to provide an angled surface on one side of the handle to support the first knuckle of a user's forefinger in a Western forehand grip.

Still another objective of the invention is to provide a concavity in the handle to receive a player's third, fourth, and fifth fingers, which helps facilitate a backhand grip.

Still another objective of the invention is to provide a thumb groove approximately transverse of the axis of the racquet so that a Western backhand grip is facilitated.

Still another objective of the invention is to provide a pair of thumb depressions.

Still another objective of the invention is to provide a pair of handle contour areas for two-handed backhand play. One contour area is for the right hand and one is for the left hand.

Still another objective of the invention is to provide an angled surface for a user's thumb to facilitate top spin backhand strokes.

Still another objective of the invention is provide a thumb depression in combination with either a bowl or protrusion to receive the area between the thumb and forefinger, or a trigger to receive the index finger. Alternatively, either a bowl or protrusion, or a trigger, could be provided by itself without a thumb depression.

In the handle configurations described herein and those described by my co-pending applications, it may be desirable to be able to cast these configurations and secure them at selective locations along the length of the handle to improve a player's performance. In one system, the handle is formed with a grooved section along a portion of its length in which rail portions of the grip are received. The grip molds are moved along the length of the racquet handle to a desired location and secured thereto by screws or the like. Then, the racquet handle is wrapped with leather strips as is conventional.

BRIEF DESCRIPTION OF THE DRAWINGS

FIG. 15 is a side elevational view showing a configuration having two thumb depressions and a reduced base periphery according to another embodiment of the invention;

FIG. 16 is a side view disclosing two contoured areas on the handle shaft according to another embodiment of the invention for those using a two-handed grip;

FIG. 17 is a side view according to another embodiment of the invention showing a contoured surface that eliminates one of the ridges of the handle;

FIG. 18 is a cross-sectional view of the racquet handle of FIG. 17 taken along line 18—18 therein;

FIG. 19*a* is an exploded perspective showing a twopiece contour assembly in accordance with one method of implementing the invention;

FIG. 20*a* is a cross section taken along line 20*a*—20*a* in FIG. 19*a* showing a pair of contour elements about to be assembled;

FIG. 21*a* is the cross section of FIG. 20*a* showing the contour elements formed as a contour assembly;

FIG. 22*a* is a perspective of a handle in accordance with FIG. 19*a* during the final stages of assembly;

DESCRIPTION OF THE PREFERRED EMBODIMENTS

Figure 1:
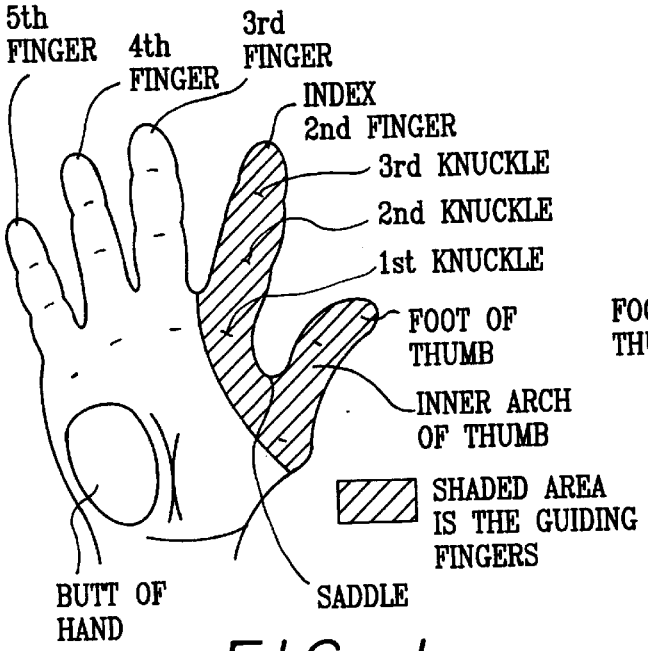
FIGS. 1–3 are views of the hand presented for purposes of nomenclature.
Figure 2:
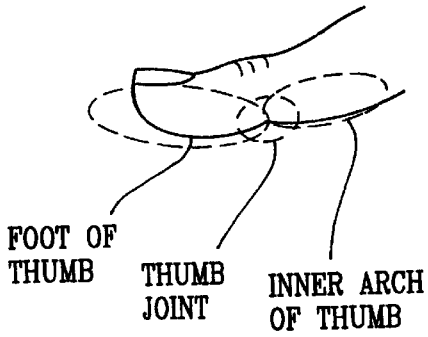
Figure 3:
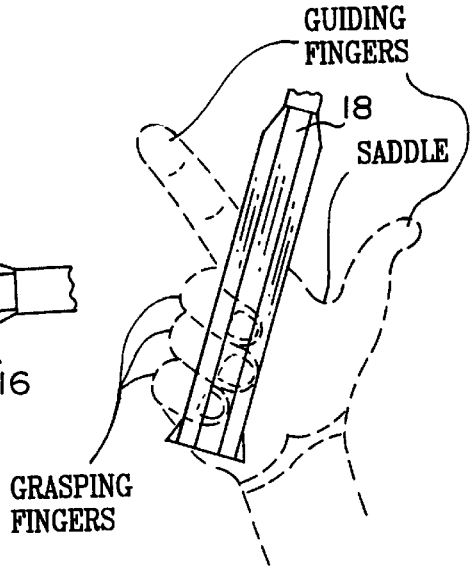

For nomenclature purposes, please refer to FIGS. 1, 2, and 3 showing the hand of a tennis player. Note that the index finger, thumb, and the saddle area have been shaded. These portions of the hand contribute guidance and control to the player. The third, fourth, and fifth fingers provide much of the grasping power. FIG. 3 illustrates this concept.

Figure 4:
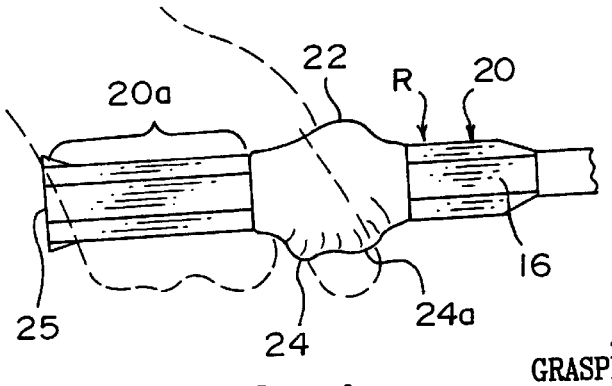
FIG. 4 is a diagrammatic side view showing a player's hand disposed over a tennis racquet handle constructed according to one embodiment of this invention.

Referring now to the other drawings wherein like numerals indicate like parts, and FIG. 4 in particular, the numeral 20 indicates a tennis racquet handle of the racquet R. The numeral 20*a* indicates a lower portion of the handle 20 adjacent a base 25. The tennis racquet handle 20, including the lower portion 20*a*, includes side surfaces 16 and 18 as shown in FIGS. 3 and 4. The top surface of the octagonal portion of the handle is indicated by the numeral 19 and the bottom surface by the numeral 19. In the parent applications a protrusion 22 and a trigger 24 have been disclosed. The protrusion 22 provides a surface against which the saddle formed by the index finger and the thumb can be placed. This engagement locates the hand and/or acts as a pivotal point when changing from forehand to backhand grips and vice versa. The trigger 24 supports the player's index finger for added control and for increasing the player's awareness of his or her hand along the length of the handle.

Figure 5:
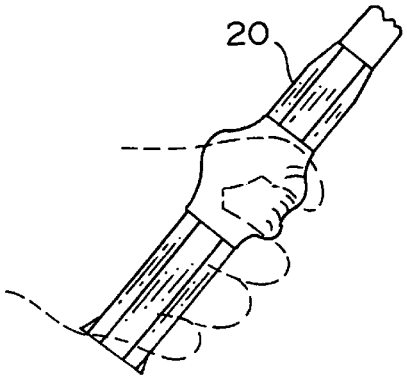
FIGS. 5 and 6 are diagrammatic side elevational views to illustrate operation.
Figure 6:
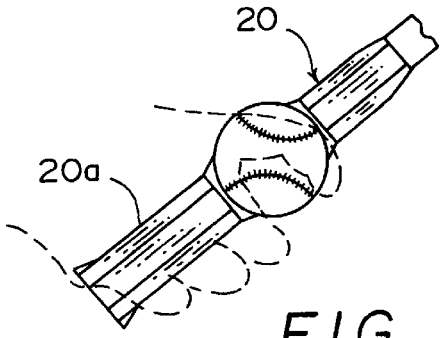

As seen in a new embodiment shown in FIG. 4, another bulge 24*a* can be added adjacent the trigger 24. The rounded surface of bulge 24*a* causes the hand to lengthen or stretch itself along the racquet and locates a portion of the index finger radially outwardly from the axis of the handle for better control and racquet head awareness for some players. The player will engage this surface 24*a*, especially in the serve and overhead, to give an extra downward force on the racquet head as the plane of the head is moving forward. This provides an extra snap action to the racquet head, much in the same way a baseball pitcher obtains spin on his curve. FIGS. 5 and 6 are diagrammatic representations of this phenomenon.

Figure 7:
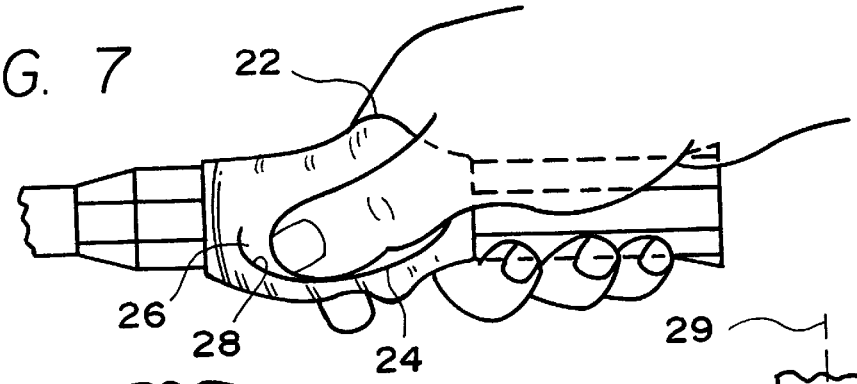
FIG. 7 is a left side elevation showing a backhand grip of another embodiment of the present invention.
Figure 8:
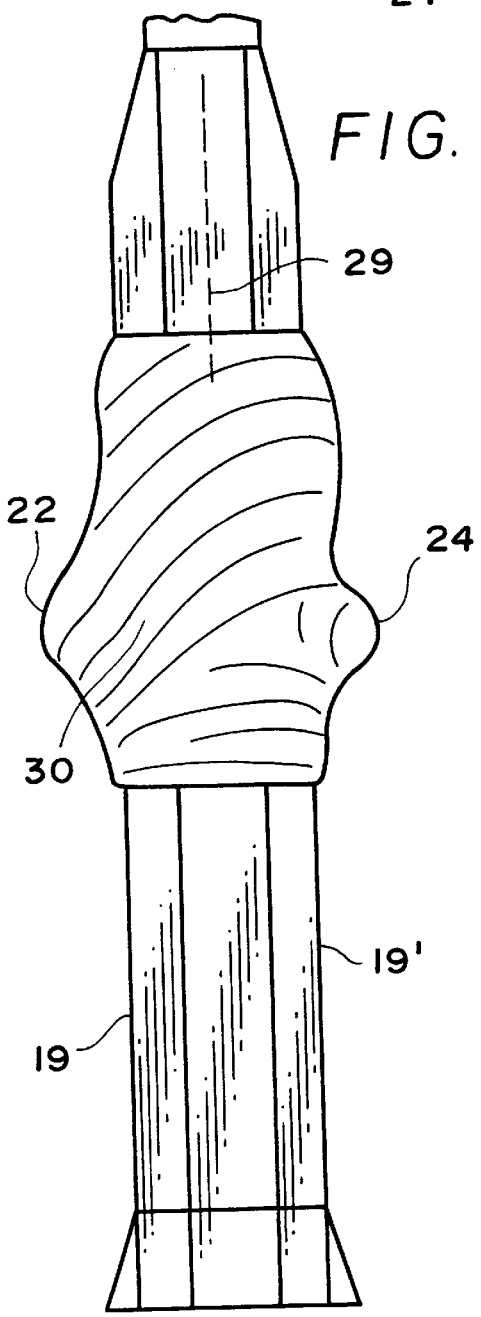
FIG. 8 is a right side view of the embodiment of FIG. 7 disclosing contours that form an offset bulge on the top surface of the handle and a trigger on the lower surface.
Figure 9:
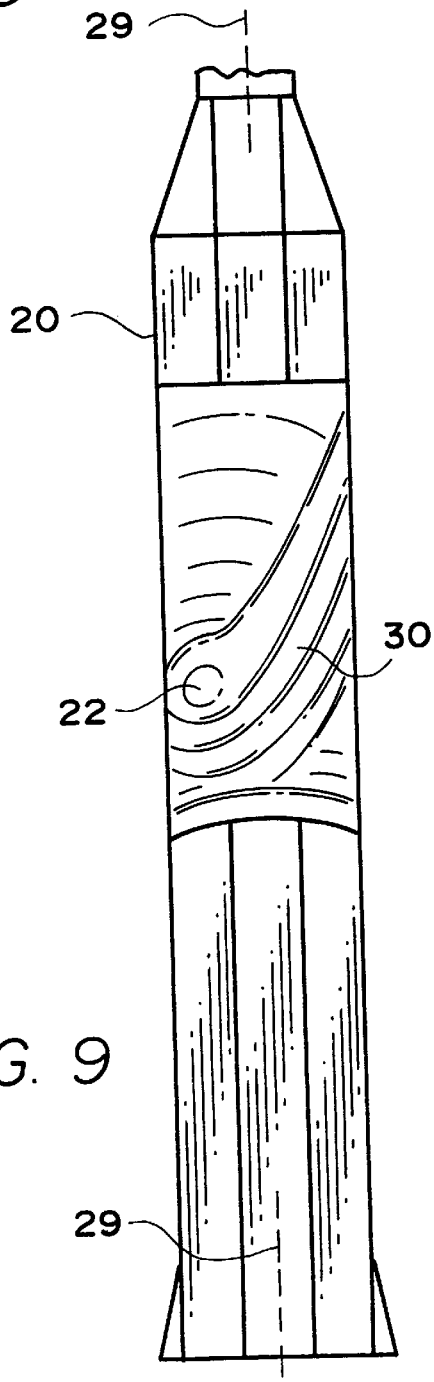
FIG. 9 is a top plan view of FIG. 8 showing the offset bulge with an angled surface to receive the base of the forefinger.

FIGS. 7, 8, and 9 disclose another embodiment wherein the bulge 22 is conveniently located to one side of the handle axis 29 and an angled planar surface 30, extending at a skewed angle to the axis 29, is formed. The surface 30 provides a natural surface for the base of the index finger when a continental grip is assumed and will act as a stop to limit hand rotation and/or correctly position the hand for backhand strokes. As seen in FIG. 7, which shows the side opposite of that shown in FIG. 8, an enlarged area 28 can be formed with a depression 26 in which a player's thumb is received.

Figure 10B:
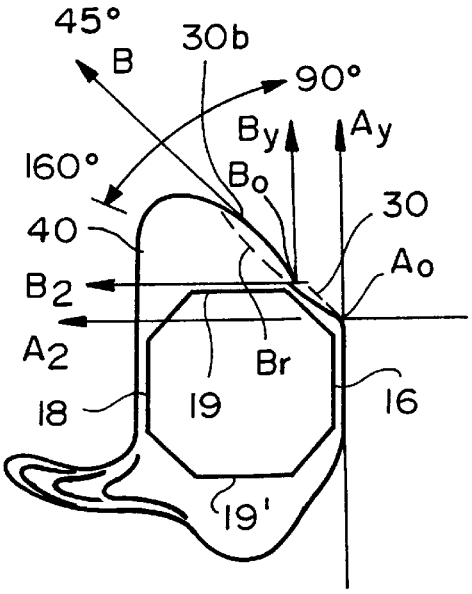
FIG. 10*b* is an end view similar to FIG. 10 showing a coordinate system for illustrating the hand cocking feature of the invention.
Figure 10:
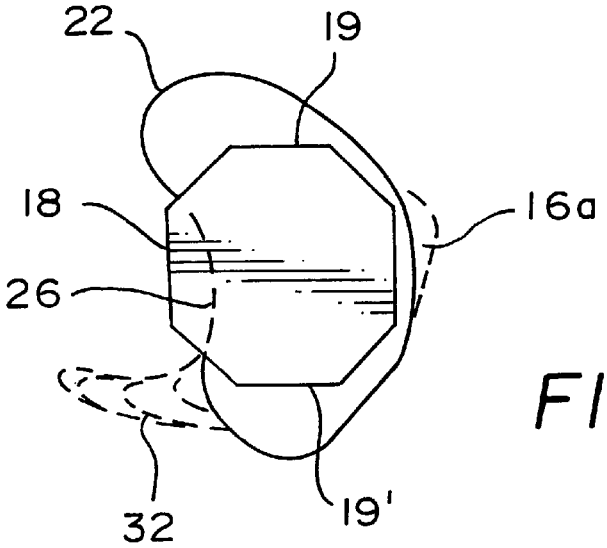
FIG. 10 is a diagrammatic end view of a racquet handle according to another embodiment of the invention showing a bulge extending outside the plane of the octagonal portion of the handle, a pronounced lip to receive the player's thumb, and a planar surface angled outwardly upon which the first knuckle of the index finger may rest.
Figure 10A:
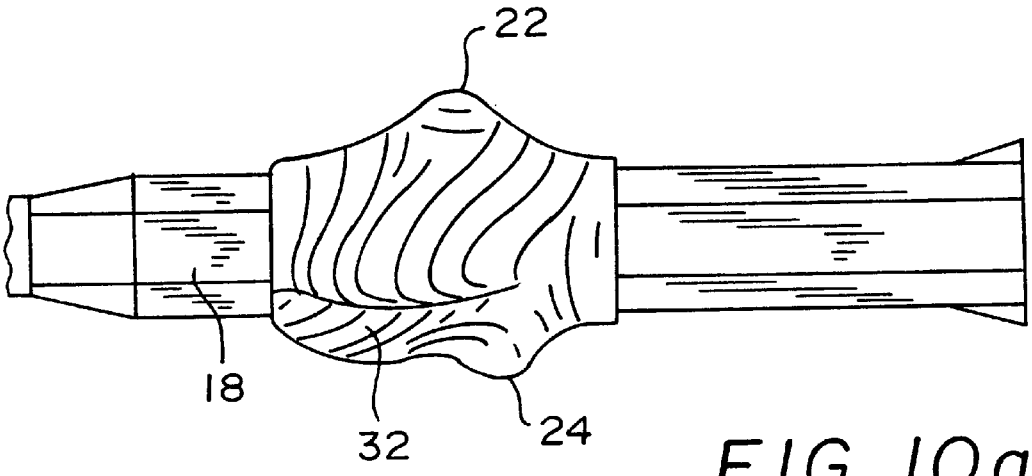
FIG. 10*a* is a left side elevation of the embodiment shown in FIG. 10.
Figure 11:
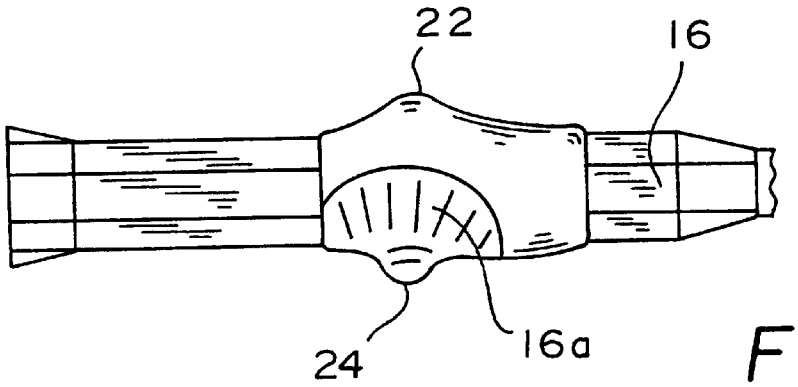
FIG. 11 is a right side view showing the outwardly angled planar surface of FIG. 10.

FIGS. 10 and 10*a* show an assembly configuration wherein the bulge 22 is angled rearwardly ("rearwardly" in the sense that the net or opposing court is located to the right as viewed in FIG. 10) with thumb depression 26 formed with an exaggerated lip 35. The multiple dotted lines show how this lip can be varied in size. Note that the depth of the depression 26 can vary widely depending on player preference. It may be very slight or so deep that its base extends below the side surface 18 of the octagonal handle. When such a configuration is used, the width of handle 20 is reduced in the area of the depression 26. Also, note in FIGS. 10 and 11 that an angled surface 16*a* is provided that angles outwardly. This surface will tilt the first knuckle of the index finger of a player toward a Western forehand position.

Figure 8A:
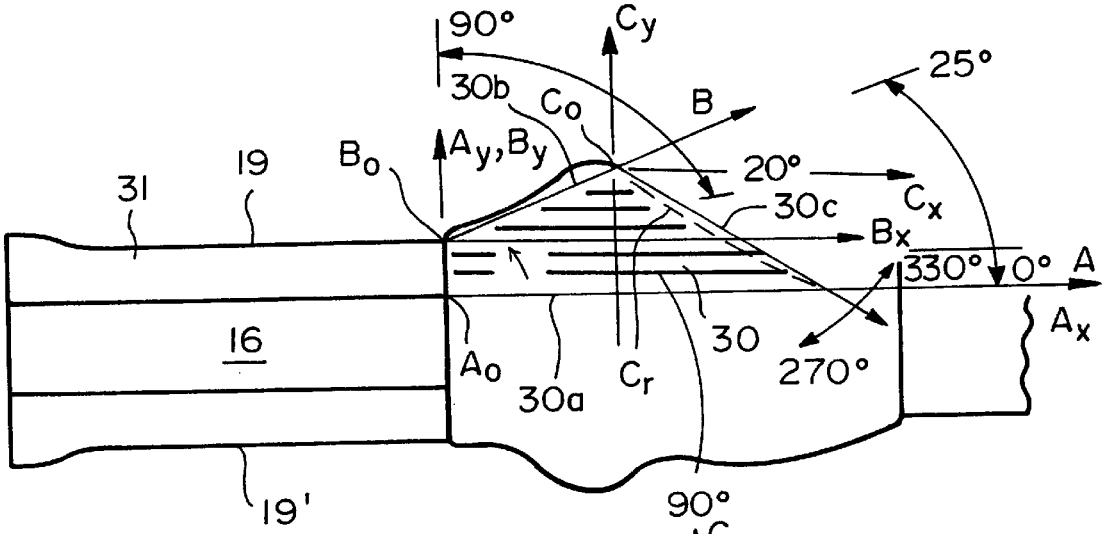
FIG. 8*a* is a right side view similar to FIG. 8 showing a coordinate system for illustrating a feature of the invention for cocking a player's hand.
Figure 9A:
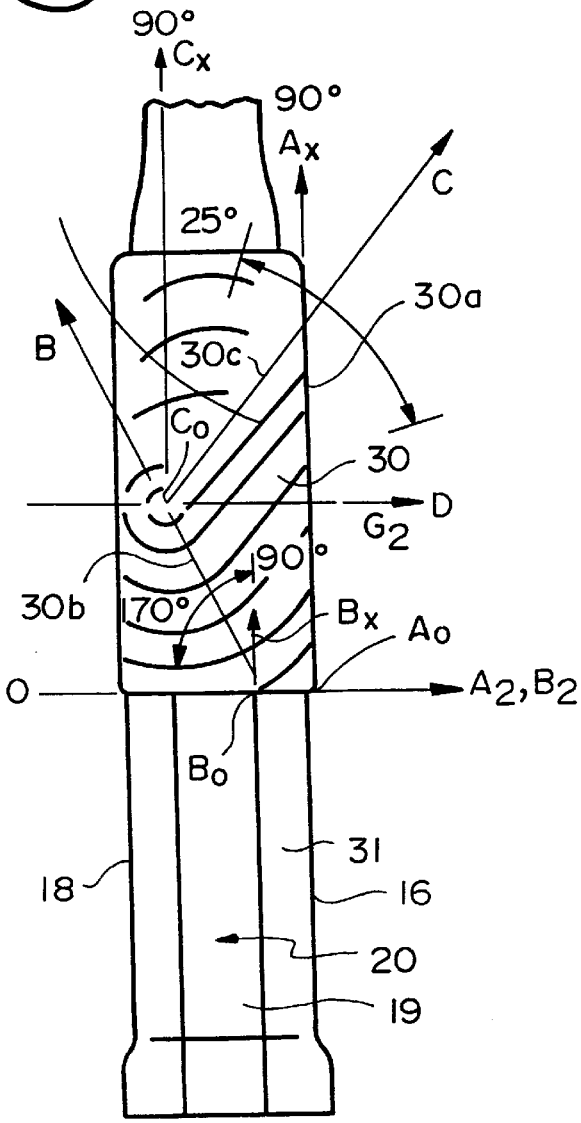
FIG. 9*a* is a top plan view similar to FIG. 9 showing a coordinate system for illustrating the hand cocking feature of the invention.

The orientation angle of surface 30 can be varied from the orientation shown in FIGS. 8, 9, and 10 to achieve a cocked hand position that some players prefer. FIGS. 8*a*, 9*a*, and 10*b* illustrate three orthogonal views of the surface 30 with coordinate systems superimposed thereon to show the geometry. FIG. 8*a* illustrates an X-Y plane view, FIG. 9*a* illustrates an Z-X plane view, and FIG. 10*b* illustrates a Z-Y plane view. There are three vectors of interest in defining the angle of surface 30 and its effect on hand position. A first vector A extends from an origin $A_o$ located at the uppermost end of the handle base portion 20*a* and at the intersection between the handle side surface 16 and a diagonal surface 31 extending between the side surface 16 and the top surface 19. Vector A extends from its origin $A_o$ along the top of the side surface 16 to define a first side 30*a* of the angled surface 30. A second vector B extends from an origin $B_o$ located at the uppermost end of the handle base portion 20*a* and at the intersection between the top surface 19 and the diagonal surface 31. Vector B extends from its origin $B_o$ and intersects the highest point of the protrusion 22 to define a second side 30*b* of the surface 30. A third vector C extends from an origin $C_o$ located at the intersection of vector B and the highest point of the protrusion 22. Vector C then extends downwardly from its origin $C_o$ to intersect vector A, and defines a third side 30*c* of the surface 30.

The angle formed by the face of surface 30 can be changed by adjusting the direction of the vectors A, B, and C. As shown in FIG. 8*a*, vector A can be adjusted in the X-Y plane defined by axes $A_x$ and $A_y$ between a nominal angle of about 0° to an angle of about 25°. Upward adjustment of vector A in the X-Y plane tends to flatten the angled surface 30 so as to raise the player's forefinger and cock the hand back. This increases the player's wrist action and is useful for increasing service power.

As shown in FIGS. 8*a*, 9*a*, and 10*b*, the vector B can be adjusted in all three planes. As shown in FIG. 8*a*, vector B can be adjusted in the plane defined by axes $B_x$ and $B_y$ between about 20° and 90°. Upward adjustment of the angle of vector B in the X-Y plane tends to steepen the slope of the protuberance 22, which helps cock the hand back for power service. As shown in FIG. 9*a*, vector B can be adjusted in the plane defined by axes $B_z$ and $B_x$ between about 90° and 170°. Upward adjustment of the angle of vector B in the Z-X plane moves the protuberance 22 toward the rearward side 18 and the base end 25 of the handle, which again helps cock the player's hand back. As shown in FIG. 10*b*, vector B can be adjusted in the plane defined by axes $B_z$ and $B_y$ between about 90° and 160°. Upward adjustment of the angle of vector B in the Z-Y plane moves the protuberance 22 toward the rearward side 18 of the handle 20.

As shown in FIGS. 8*a* and 9*a*, vector C can be varied in the X-Y plane and the Z-X plane. As shown in FIG. 8*a*, vector C can be varied in the plane defines by axes $C_x$ and $C_y$ between about 270° and 330°. Upward adjustment of vector C in the X-Y plane flattens the surface 30 and increases cocking of the player's hand. As shown in FIG. 9*a*, vector C can be varied in the plane defined by axes $C_z$ and $C_x$ between about 20° and 70°. Upward adjustment of vector C in the Z-X plane tends to cock the player's wrist to the left (for right-handed players) by leftward rotation of the player's forefinger.

It will also be observed, in FIG. 10*b* in particular, that the angled surface 30 need not be planar. It may have a concave curvature with a positive radius of curvature or a convex curvature with a negative radius of curvature. FIG. 10*b* illustrates a radius of curvature Br taken along vector B. As shown in FIG. 8*a*, another radius of curvature Cr can be taken along vector C. As shown in FIG. 9*a*, different radii of curvature could be measured on angled surface 30 in any direction between vectors B and C, it being understood that surface 30 could have a complex compound curvature. Along any given vector extending from origin $C_o$, the curvature of surface 30 could range anywhere from infinity, for a planar surface, to as little as one inch or less, for a highly curved concave surface, to negative values for a concave surface.

Figure 12:
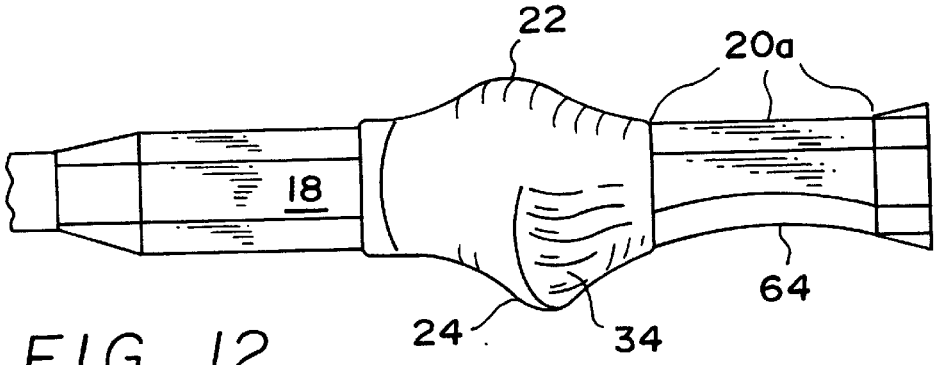
FIG. 12 is a side elevational view disclosing another embodiment of the invention in which there is a transverse thumb groove and also showing a reduced (concaved) periphery of the handle in the area of the grasping fingers.
Figure 12A:
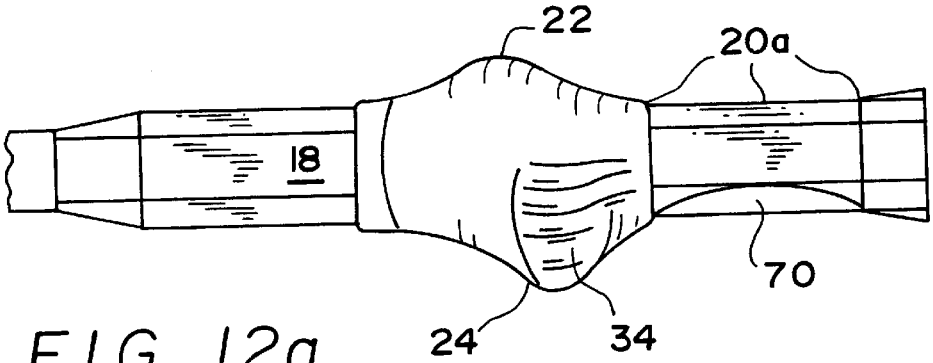
FIG. 12*a* is a view similar to FIG. 12 showing a transverse thumb groove and also showing a reduced (tapered) periphery of the handle in the area of the grasping fingers.
Figure 13:
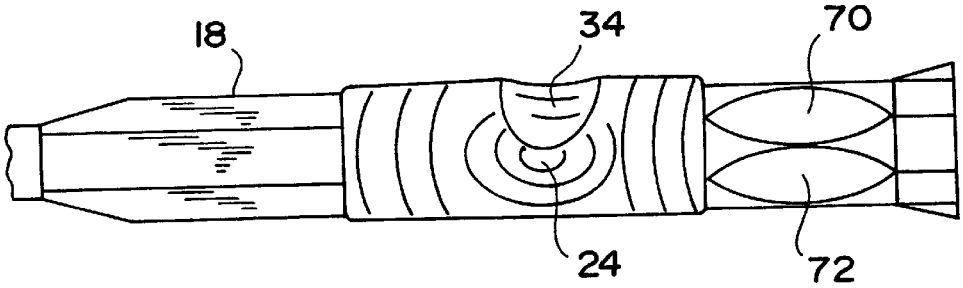
FIG. 13 is a bottom plan view of FIG. 12*a* showing how the transverse groove is partially formed in the trigger and disclosing structure for reducing the periphery of the handle base as disclosed in FIG. 12*a;*

Turning now to FIG. 12, the lower handle portion 20*a* of the racquet R next to the base 25 can be formed with a gentle arc 64 on the surface below the trigger 24. This provides a comfortable position (reduced periphery) for the three fingers which grasp that portion of the racquet, especially when a backhand grip is used. The concave surface formed by arc 64 can be used on all the embodiments described. This reduction in handle diameter can also be formed by shaving or otherwise reducing the ridged portions of the lower handle portion 20*a*, as shown by numerals 70 and 72 in FIGS. 12*a* and 13. As seen in those figures, tapering depressions 70 and 72 will provide a better grasp for some players by reducing the periphery of the handle in the area of the grasping fingers.

In the parent applications, the thumb-receiving surfaces or bowls are formed so that the thumb is fully supported while angularly disposed with respect to the axis of the handle. Some players prefer to have the thumb in a plane perpendicular or almost perpendicular to the axis of the handle to effect a Western backhand grip. An embodiment with this improvement is seen in FIGS. 12, 12*a*, 13, and 14. A groove 34 is formed transverse to the axis of the handle. Note in FIG. 13, in particular, this groove is partially formed in trigger 24. The thumb depression groove 34 does not interfere with the main functions of the trigger element.

Figure 14:
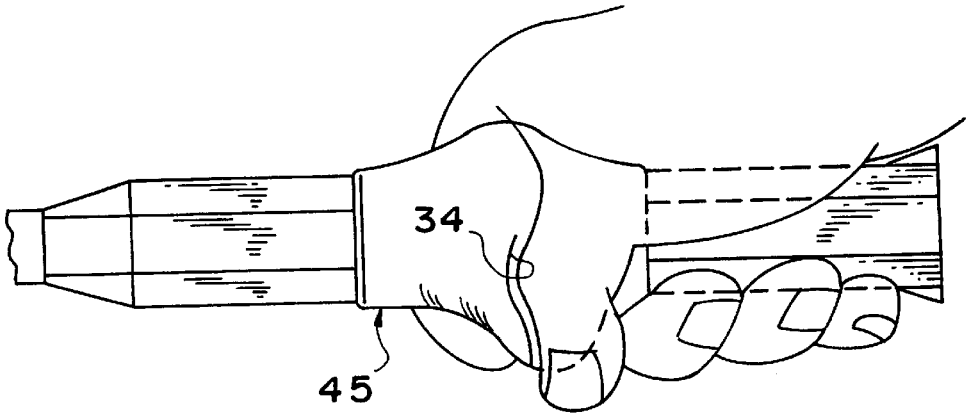
FIG. 14 is a side elevational view disclosing the embodiment of the invention in which there is a thumb groove transverse to the axis handle and also showing a player's hand and a handle without a lower handle concavity.

FIG. 14 shows the transverse thumb groove 34 without any concavity in the lower handle position 20*a*.

FIG. 15 is a side elevational view showing the thumb located in a transverse depression 37 depicted by a circle. The same player can use the oval depression 39 if that is more comfortable and advantageous. In all variations of the invention, a player can dispose his hand in certain but different positions. Also, the designs herein shown will strengthen many shots—for instance, the backhand—without interfering with a player's forehand and volley shots.

FIG. 16 is a side elevational view demonstrating two contoured areas on a handle 20. The first area 50, nearest the base 25 of the handle 20, is for the one hand, and a second area 52, placed farther up the handle 20 in the reverse direction, is to accommodate the other hand. This enables a two-handed player to take advantage of the contoured area configurations disclosed herein.

FIG. 17 is a side elevational view showing the angularly disposed planar surface 67. FIG. 18 is a cross-sectional view taken along line 18—18 in FIG. 17. The planar surface 67 is oriented at an angle to the plane of the racquet head. When gripped, this angularly disposed surface 67 will have a tendency to cause the user to tilt the racket head, making it easier to execute top spin backhands.

Although the foregoing configurations are believed to work best for most players, there may be some players who prefer handles with only some of the disclosed configuration elements. It will be understood, therefore, that each of the disclosed configuration elements could be used either alone or in combination with other configuration elements. For example, some players may prefer to use one or more thumb depressions in combination with one or more triggers, but not a bowl or protrusion for engaging the area between the thumb and forefinger. Still other players may find it beneficial to combine one or more thumb depressions with a bowl or protrusion, but not a trigger. As previously stated, the depth of the one or more thumb depressions can vary depending on player preference.

The handle configurations taught herein and in the parent applications can be integrally formed on a racquet by molding or otherwise shaping the racquet material itself. For example, if the racquet has a wood frame, the handle can be formed by shaping the wooden stem portion of the racquet frame into one of the disclosed configurations. Modern day octagonal racquet handles, however, are usually formed as a tubular plastic sleeve mounted over an inner handle shaft of rectangular shape. It is contemplated that the disclosed handle configurations can also be formed as a tubular element slipped over the end of an existing handle structure.

The tubular element could replace the conventional octagonal handle or could be mounted over it. Alternatively, the tubular element could be mounted over other handle structures having other shapes. In each case, when a tubular construction is used, the interior configuration of the tube is preferably shaped to closely match the exterior configuration of the handle structure on which it is mounted. If the handle structure on which the tubular element is mounted is octagonal, which it would be if the tubular element is mounted over an existing octagonal handle, the interior surface is formed octagonally. If the handle structure on which the tubular element is mounted is rectangular, which it would be if the tubular element is added during initial racquet manufacture, or if the tubular element is added to an existing racquet after removing the original octagonal handle, the interior surface is formed rectangularly. If the interior of the tubular element does not conform exactly to the shape of the surface on which the element is mounted, it should at least fit snugly enough to prevent relative movement between the two structures.

It has been found that there are sometimes factors of economy and performance which can be obtained if the tubular element is molded separately of two different contoured pieces 44 and 46. The pieces can then be connected into a contoured assembly 45. This method will preserve the integrity of normal racquet production while permitting a great deal of tailoring for the hand of the particular player involved.

In FIG. 19*a* there are a pair of contoured elements 44 and 46 that, when connected together, form an octagonal inner surface 49 to engage the octagonal periphery 54 of a handle structure in the form of the lower handle portion 20*a*.

If desired, the elements 44 and 46 can be made to snap together around the handle portion 20*a*. Alternatively, as seen in FIG. 19*a*, the upper and lower surfaces of the handle portion 20*a* can be formed with T-shaped grooves 40 and 42 substantially throughout the length thereof. As shown in FIGS. 20*a* and 21*a*, the interior of elements 44 and 46 are formed with one or more T-shaped members or rails 48 and 50, respectively, for reception by these grooves. Extending downwardly from upper piece 44 is a T-shaped rail 48 adapted to be snugly received in a matching groove 40. Extending upwardly from lower piece 46 is a T-shaped rail 50 adapted to be snugly but slidably received in a groove 42. The assembly 45 can have the configurations molded according to any of the embodiments shown in this or in the parent applications.

As seen from FIG. 22*a*, a tubular element 75 is made either as a unitary sleeve or formed from the two contoured elements 44 and 46 connected together as the contour assembly 45. The tubular element 75 can be moved axially along the lower handle portion 20*a* to a selected location where the tubular element can be affixed to the handle by way of a screw 55 or the like. The upper side of the tubular element 75 is formed with an aperture 56 to receive the screw 55.

After securement of the tubular element 75, the remainder of the lower handle portion 20*a* is then wrapped by a conventional strap 58 (usually leather) in known fashion from the base 25 up to the tubular element 75. The strap is secured and bonded to the handle in the normal fashion.

Figure 19B:
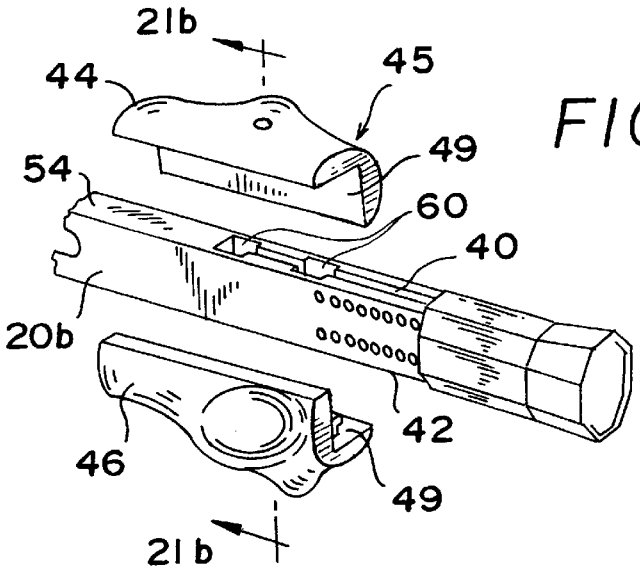
FIG. 19*b* is an exploded perspective showing a twopiece contour assembly in accordance with another method of implementing the invention.

In FIG. 19*b* there are a pair of contoured elements 44 and 46 that, when connected together, form a rectangular inner surface 49 to engage the rectangular periphery 54 of a handle structure in the form of a handle inner shaft 20*b*.

Figure 20B:
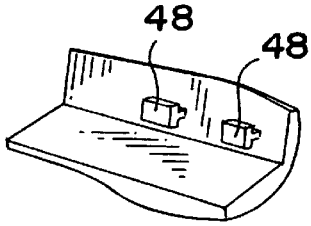
FIG. 20*b* is a partial bottom view of one of the contour elements shown in FIG. 19*b* disclosing inwardly directed rails.
Figure 21B:
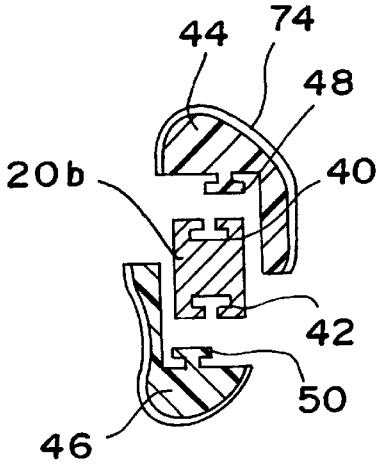
FIG. 21*b* is a cross section taken along line 21*b*—21*b* in FIG. 19*b* showing the contour elements formed as a contour assembly.

If desired, the elements 44 and 46 can be made to snap together around the handle inner shaft 20*b*. Alternatively, as seen in FIG. 19*b*, the upper and lower surfaces of the handle inner shaft 20*b* can be formed with T-shaped grooves 40 and 42 substantially throughout the length of the handle inner shaft. As shown in FIGS. 20*b* and 21*b*, the interior of elements 44 and 46 are formed with two T-shaped members or rails 48 and 50, respectively, for reception by these grooves. Thus, extending downwardly from upper piece 44 are two T-shaped rails 48 adapted to be snugly received in a matching groove 40. Extending inwardly and upwardly from lower piece 46 are two T-shaped rails 50 adapted to be snugly but slidably received in a groove 42. Enlarged openings 60 along the grooves 40 and 42 are sized to receive the flanged portions of the T-shaped rails 48 and 50, and will facilitate mounting the pieces 44 and 46 to the handle inner shaft 20*b*. The assembly 45 can have the configurations molded according to any of the embodiments shown in this or in the parent applications.

FIG. 21*b* shows an exterior covering 74 over contoured elements 44 and 46. The covering 74 is made of a cushioning material which adds to comfort and shock absorption.

Figure 22B:
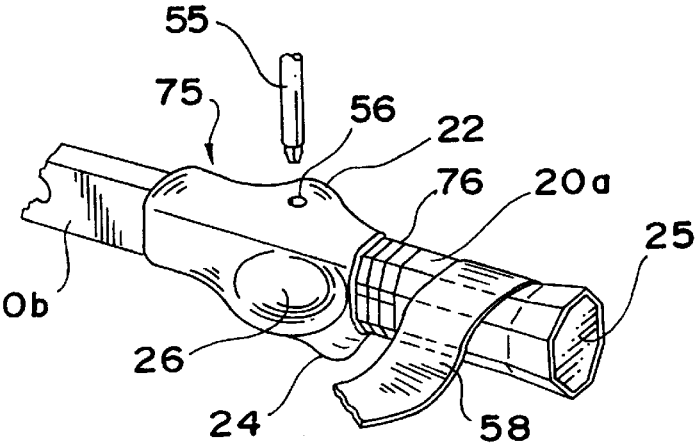
FIG. 22*b* is a perspective of a handle in accordance with FIG. 19*b* during the final stages of assembly.

As seen from FIG. 22*b*, a tubular element 75 is made either as a unitary sleeve or formed from the two contoured elements 44 and 46 connected together as the contour assembly 45. The tubular element 75 which can be moved axially along the handle inner shaft 20*b* to a selected location where the tubular element can be affixed to the handle by way of a screw 55 or the like. The upper side of the tubular element 75 is formed with an aperture 56 to receive the screw 55.

Figure 23:
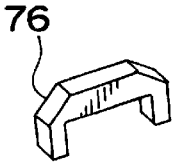
FIG. 23 is a perspective view of a two-piece spacer piece.
Figure 24:
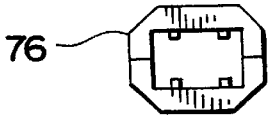
FIG. 24 discloses how the spacer pieces of FIG. 23 engage one another.

After securement of the tubular element 75, the lower handle portion 20*a*, formed by a conventional octagonal sleeve, is mounted on the handle inner shaft 20*b*. The lower handle portion 20*a* is then wrapped by a conventional strap 58 (usually leather) in known fashion from the base 25 up to the tubular element 75. The strap is secured and bonded to the handle in the normal fashion. If a gap remains between the tubular element 75 and the lower handle portion 20*a*, a filler or filler rings 76 can be inserted before wrapping with the strap 58. As shown in FIGS. 23 and 24, the fillers or rings 76 are either friction-fitted or snapped or glued to the handle inner shaft 20*b* prior to wrapping with strap 58. The fillers 76 provide a smooth transition between the tubular element 75 and the lower handle portion 20*a*. They can also be used in the two-handed embodiment of FIG. 16 between the contour areas 50 and 52 to adjust the spacing thereof.

The grooves 40 and 42 need not run the entire length of the handle inner shaft 20*b* if shorter grooves are desired. If shorter grooves are desired, a modification of the T-shaped grooves is made. In the event the tubular element 75 is molded in one piece, the grooves will be formed so as to extend to the lower end of the handle inner shaft 20*b*.

It should be understood that certain commercial adhesives can be used to secure pieces together during assembly. For instance, the engaging of contoured elements 44 and 46 can be secured by an adhesive. The same is true for fillers 76 and 77.

Although the means for securing and locating the tubular element 75 along the length of the handle inner shaft 20*b* is described with respect to a particular contoured assembly, it should be understood that such location means can be used for all embodiments as well as the two-handed embodiment.

There have been described several new racquet handle configurations with means for adjustment. The embodiments described herein are illustrative of the invention but should not be construed as limitations upon the rights of the invention, which are defined by the scope of the herein-after appended claims.

I claim:

1. A handle configuration for a racquet that supports a stringed racquet head at its outer end and is terminated at a base comprising a handle having an exterior surface including first and second opposed sides wherein said first side is formed with a first groove throughout a portion of its length and wherein said second side is formed with a second groove throughout a portion of its length;

an assembly having an exterior surface of designed contour and an interior surface closely patterned and sized to receive said exterior surface of said handle;

first and second rails extending inwardly of said interior surface and respectively and slidably received in said first and second grooves so that said assembly can be moved to a selected position along the length of said handle; and means to secure said assembly at said selected position.

2. The invention of claim 1 wherein said rails have T-shaped cross sections and said grooves have T-shaped interiors.

3. The invention of claim 1 wherein a cross section of said interior surface forms a polygon.

4. The invention of claim 3 wherein said polygon is an octagon.

5. The invention of claim 1 wherein said means are screws securing said assembly to said handle.

6. The invention of claim 1 wherein said designed contour includes a first protrusion extended from said assembly and is located to engage the connecting saddle between the thumb and forefinger of a user;

said contour further including a trigger protrusion extending outwardly from said assembly and located for engagement with a user's forefinger when said first protrusion is engaged by said saddle; and a depression formed in said designed contour transverse to the axis of said handle for reception of the thumb of the user when said saddle engages said first protrusion.

7. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position; and means for securing said contoured element to said handle at said selected position.

8. The invention of claim 7 wherein said means for securing is at least one screw.

9. A handle configuration for a racquet that supports a stringed racquet head at its outer end and is terminated at a base comprising an eight-sided handle with a surface formed by four pairs of opposed parallel sides, and including a central longitudinal axis and an octagonal cross section;

a hollow grip assembly having an exterior contoured surface and an interior surface corresponding to said eight-sided handle and slidably received thereby;

inter-engagement means formed on one of said pairs of handle sides and on said grip assembly interior surface for inter-engaging said handle and said grip assembly and to permit said grip assembly to move longitudinally on said handle to a selected location; and means to affix said grip assembly to said handle at said selected position.

10. The invention of claim 9 wherein said grip assembly exterior contoured surface includes a first protrusion extending outwardly from a first side of said handle and adapted to engage the connecting saddle between the thumb and forefinger of a user; and a trigger protrusion extending outwardly from a second side of said handle parallel to said first side, said trigger protrusion being located for engagement with a user's forefinger when said first protrusion is engaged by said saddle.

11. The invention of claim 10 wherein there is a rounded bulge formed on said grip assembly exterior contoured surface adjacent to said trigger protrusion.

12. The invention of claim 10 wherein said first protrusion is angularly disposed with respect to the longitudinal axis of said handle.

13. The invention of claim 10 wherein said first protrusion has an outer end and said outer end falls outside the plane of a third side of said handle that lies in a plane normal to said first side.

14. The invention of claim 10 wherein a first thumb depression is formed in said grip assembly exterior contoured surface and partially falls in said trigger protrusion.

15. The invention of claim 14 wherein said grip assembly exterior contoured surface further includes a second thumb depression angularly disposed with respect to said first thumb depression.

16. A handle configuration for a racquet that supports a stringed racquet head at its outer end and is terminated at a base comprising a handle having a polygonal cross section, an exterior surface having at least two opposed sides, and a central longitudinal axis;

a hollow grip assembly having an exterior contoured surface and an interior surface corresponding to said handle exterior surface and slidably received thereby;

inter-engagement means formed on said first and second sides of said handle exterior surface and on said grip assembly interior surface for inter-engaging said handle and said grip assembly and to permit said grip assembly to move longitudinally on said handle to a selected position;

means for affixing said grip assembly to said handle at said selected position at a distance from said base sufficient to receive three fingers of a user; and said handle being formed with a concave surface between said base and said selected position.

17. The invention of claim 16 further including a second hollow grip assembly having an exterior contoured surface and an interior surface corresponding to said handle exterior surface and slidably received thereby;

second inter-engagement means formed on said first and second sides of said handle exterior surface and on said second grip assembly interior surface for inter-engaging said handle and said second grip assembly and to permit said second grip assembly to move longitudinally on said handle to a second selected position; and second means for affixing said second grip assembly to said handle at said second selected position.

18. The invention of claim 16 wherein said grip assembly is covered with a cushioned layer.

19. A handle configuration for a racquet that supports a stringed racquet head at its outer end and is terminated at its base comprising a handle having an exterior polygonal surface;

a first assembly having an exterior surface of designed contour and an interior closely patterned and sized to receive said polygonal exterior surface of said handle;

first inter-engagement means formed on said handle exterior surface and on said first assembly interior surface for inter-engaging said handle and said first assembly and to permit said first assembly to move longitudinally on said handle to a first selected position;

first means for securing said first assembly at said first selected position on said handle;

a second assembly having an exterior surface of designed contour and an interior closely patterned and sized to receive said handle exterior surface of said handle;

second inter-engagement means formed on said handle exterior surface and on said second assembly interior surface for inter-engaging said handle and said second assembly and to permit said second assembly to move longitudinally on said handle to a second selected position displaced from said first selected position; and second means for securing said second assembly at said second selected position on said handle.

20. A handle configuration for a racquet that supports a stringed racquet head at its outer end and is terminated at a base comprising a handle having an exterior polygonal surface;

an assembly having an exterior surface of designed contour and an interior surface closely patterned and sized to receive said handle exterior surface;

inter-engagement means formed on said handle exterior surface and on said assembly interior surface for inter-engaging said handle and said assembly and to permit said assembly to move longitudinally on said handle to a selected position;

means for securing said assembly at said selected position on said handle;

a first protrusion located on said assembly exterior surface to engage the connecting saddle between the thumb and forefinger of a user;

a first trigger located on said assembly exterior surface to engage a user's forefinger when said first protrusion is engaged by said saddle; and a second rounded protrusion located on said assembly adjacent to said trigger.

21. A handle configuration for a racquet that supports a stringed racquet head at its outer end and is terminated at a base, comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a user;

a first trigger located on said contoured element exterior surface to engage a user's forefinger when said first protrusion is engaged by said saddle; and said first protrusion being provided on one side of a central axis of said handle and defining a surface extending at a skewed angle to said axis to engage a base of a user's forefinger.

22. The invention of claim 21 wherein said first protrusion extends beyond one of the sides of said handle.

23. The invention of claim 21 further including a thumb depression located in said contour element exterior surface to engage the thumb of a user.

24. The invention of claim 21 further including a thumb supporting lip located on said contour element exterior surface to engage the bottom of the thumb of a user.

25. A handle configuration for a racquet that supports a stringed racquet head at its outer end and is terminated at a base, comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a user;

a first trigger located on said contoured element exterior surface to engage a user's forefinger when said first protrusion is engaged by said saddle; and an angled surface located on said contoured element exterior surface to support the first knuckle of a user's forefinger.

26. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a user;

a first trigger located on said contoured element exterior surface to engage a user's forefinger when said first protrusion is engaged by said saddle; and a concave surface disposed on said contoured element exterior surface adjacent to said trigger to receive the third, fourth, and fifth fingers of a user.

27. The invention of claim 26 wherein said concave surface is formed by an arc.

28. The invention of claim 27 wherein said concave surface is formed by a pair of tapering depressions.

29. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a user;

a first trigger located on said contoured element exterior surface to engage a user's forefinger when said first protrusion is engaged by said saddle; and a thumb depression formed on said contoured element exterior surface on one side of said handle configuration and extending transversely with respect to a central axis of said handle.

30. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a user;

a first trigger located on said contoured element exterior surface to engage a user's forefinger when said first protrusion is engaged by said saddle; and a pair of thumb depressions located on said contoured element exterior surface to engage a user's thumb.

31. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a first hand of a user;

a first trigger located on said contoured element exterior surface to engage a user's forefinger on said first hand when said first protrusion is engaged by said saddle;

a second protrusion located on said contoured element exterior surface to engage the connecting saddle between the thumb and forefinger of a second hand of a user; and a second trigger located on said contoured element exterior surface to engage a user's forefinger on said second hand when said second protrusion is engaged by said saddle.

32. A handle configuration for a racquet that supports a stringed racquet head at its outer end and is terminated at a base, comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a user;

a first trigger located on said contoured element exterior surface to engage a user's forefinger when said first protrusion is engaged by said saddle; and an angled surface located on said contoured element exterior surface to engage a user's thumb.

33. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a first protrusion located on said contoured element exterior surface to engage the connecting saddle between the thumb and forefinger of a user;

a first trigger located on said contoured element exterior surface to engage a user's forefinger when said first protrusion is engaged by said saddle;

said first protrusion defining a surface extending at a skewed angle to a central longitudinal axis of said handle to engage a base of a user's forefinger; and said surface being angled so as to cock back a user's hand when said handle is grasped.

34. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a thumb depression located on said contoured element exterior surface to engage the thumb of a user; and a first trigger located on said contoured element exterior surface to engage a user's forefinger.

35. A handle configuration for a racquet that supports a stringed racquet head at its outer end and is terminated at a base comprising a handle having an exterior surface including first and second opposed sides;

a contoured element having an exterior surface of designed contour and an interior surface closely patterned and sized to receive said handle exterior surface;

inter-engagement means formed on said first and second sides of said handle exterior surface and on said contoured element interior surface for inter-engaging said handle and said contoured element and to permit said contoured element to move longitudinally on said handle to a selected position;

means for securing said contoured element to said handle at said selected position;

a thumb depression located on said contoured element exterior surface to engage the thumb of a user; and a first protrusion located said contoured element exterior surface to engage the connecting saddle between the thumb and forefinger of a user.

* * * * *